US006257015B1

(12) United States Patent
Incorvia et al.

(10) Patent No.: US 6,257,015 B1
(45) Date of Patent: Jul. 10, 2001

(54) SELF-RETAINING ADSORBENT UNIT

(75) Inventors: Samuel A. Incorvia, North Tonawanda; Peter R. Millen, Perry; John R. Semler, Williamsville, all of NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 0 days.

(21) Appl. No.: 09/488,408

(22) Filed: Jan. 19, 2000

(51) Int. Cl.[7] ..... F25B 43/04
(52) U.S. Cl. ..... 62/475; 62/503; 62/474
(58) Field of Search ..... 62/503, 475, 474

(56) References Cited

U.S. PATENT DOCUMENTS

| | | | | |
|---|---|---|---|---|
| 4,116,649 | * | 9/1978 | Cullen et al. | 55/387 |
| 4,405,347 | * | 9/1983 | Cullen et al. | 55/387 |
| 4,619,673 | | 10/1986 | Cullen et al. | 55/387 |
| 4,866,951 | * | 9/1989 | Masterson, II | 62/503 |
| 4,911,739 | | 3/1990 | Cullen et al. | 55/387 |
| 4,994,185 | | 2/1991 | Cullen et al. | 210/282 |
| 5,636,525 | | 6/1997 | Riemenschneider | 62/474 |
| 5,651,266 | * | 7/1997 | Hutchison et al. | 62/474 |
| 5,729,998 | * | 3/1998 | Grohs et al. | 62/474 |
| 5,827,359 | * | 10/1998 | Dobson et al. | 96/147 |
| 5,914,456 | * | 6/1999 | LeConey et al. | 96/121 |
| 5,987,915 | | 11/1999 | Incorvia et al. | 62/474 |
| 5,996,371 | * | 12/1999 | Riemenschneider | 62/474 |
| 6,083,303 | * | 7/2000 | LeConey et al. | 96/121 |

* cited by examiner

*Primary Examiner*—William Doerrler
*Assistant Examiner*—Mark Shulman
(74) *Attorney, Agent, or Firm*—Joseph P. Gastel

(57) ABSTRACT

An adsorbent unit for mounting relative to a U-bend pipe of a refrigerant accumulator having spaced pipes and a return bend including a porous container, adsorbent in the container, first and second end portions on the container, first and second bands on the first end portion for placement about the spaced pipes, and a mounting tab at the second end portion for mounting onto a filter housing on the return bend.

14 Claims, 2 Drawing Sheets

SELF-RETAINING ADSORBENT UNIT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved adsorbent unit for use in a refrigerant accumulator of an air conditioning system which contains a U-shaped return bend pipe.

By way of background, in the past when a single adsorbent unit was utilized in a refrigerant accumulator having a U-shaped return bend pipe, certain embodiments had to be secured relative to the spaced pipes by means of an external tie or clip which required extra parts and/or additional manipulative steps. It is with overcoming the foregoing deficiencies of certain prior art adsorbent units that the present invention is concerned.

BRIEF SUMMARY OF THE INVENTION

It is the object of the present invention to provide an improved single container adsorbent unit for a U-bend pipe of a refrigerant accumulator in which the mounting structure is an integral portion of the adsorbent unit itself. Other objects and attendant advantages of the present invention will readily be perceived hereafter.

The present invention relates to an adsorbent unit for mounting relative to a U-bend pipe of a refrigerant accumulator having spaced pipes and a return bend comprising a porous container, adsorbent in said container, first and second end portions on said container, first and second bands on said first end portion for placement about said spaced pipes with said container located between said first mounting means and said return bend, and second mounting means at said second end of said container for mounting relative to said return bend.

The present invention also relates to a refrigerant accumulator having a housing with a bottom wall and a side wall and a U-shaped pipe with a return bend adjacent said bottom wall and with first and second pipe portions extending from said return bend along said side wall, and a filter body extending outwardly from said return bend, the improvement of an adsorbent unit comprising a porous adsorbent container, adsorbent in said container, first and second end portions on said container, first and second bands, inner ends on said first and second bands secured to said first end portion, outer ends on said first and second bands, means securing said outer ends of said first and second bands to each other in looping engagement with said first and second pipe portions, a tab extending outwardly from said second end portion of said container, and an aperture on said tab mounting said second tab on said filter body.

The various aspects of the present invention will be more fully understood when the following portions of the specification are read in conjunction with the accompanying drawings wherein:

DETAILED DESCRIPTION OF THE INVENTION

Figure 1:
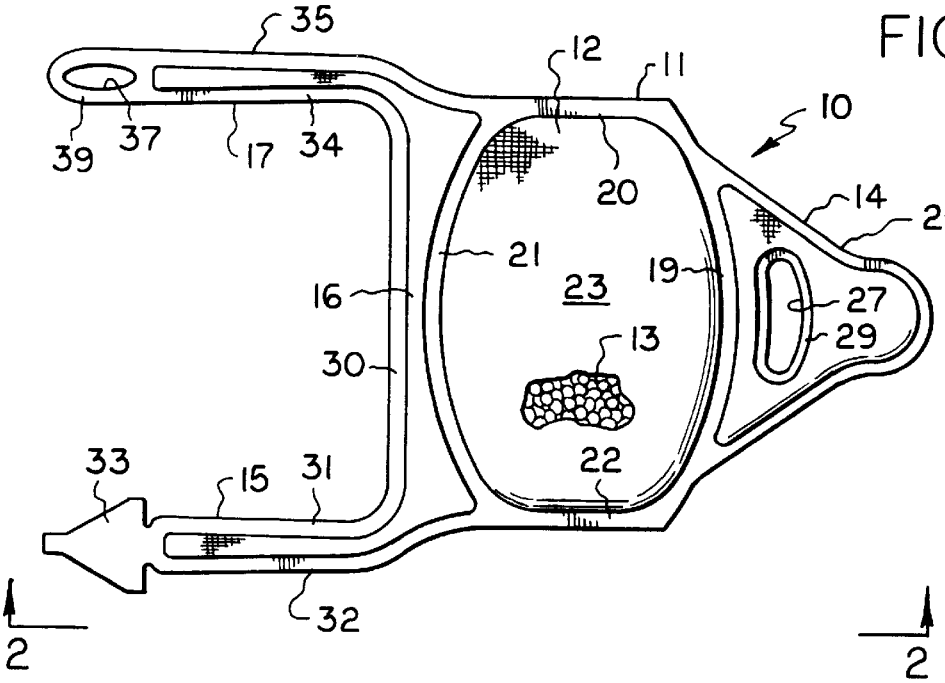
FIG. 1 is a partially broken away plan view of the adsorbent unit of the present invention.
Figure 2:
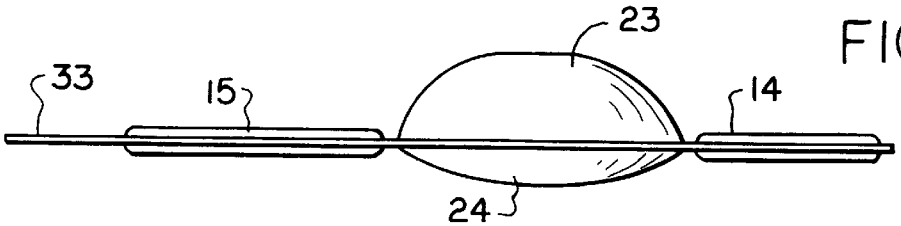
FIG. 2 is a side elevational view taken substantially in the direction of arrows 2—2 of FIG. 1.

The adsorbent unit 10 of the present invention includes a casing 11 formed of porous material, in this instance, heat-fusible felted polyester, but it may be fabricated of any other suitable material. Casing 11 is formed from two sides of felted polyester which are bonded to each other by fused seams, and it comprises a container 12 containing adsorbent 13 with the container having an apertured tab 14 extending outwardly from one end portion thereof and bands 15 and 17 extending outwardly from the other end portion thereof. The preferred adsorbent is molecular sieve but any other suitable adsorbent may be used.

Container 12 is defined by fused seams 19, 20, 21 and 22. Container 12 has a pronounced convex surface 23 and a less convex surface 24. Tab 14 includes an outer fused seam 25 which merges into seam 19. Tab 14 includes an elongated aperture 27 which is defined by fused seam 29.

Tabs 15 and 17, as noted above, extend outwardly from end portion 16. The outer edge of end portion 16 includes a fused seam 30 which is spaced from fused seam 21 of container 12. Tab 15 is defined by fused seam 31 which merges into fused seam 30 and by fused seam 32 which merges into the junction of fused seams 21 and 22. A barb 33 is formed at the outer end of band 15, and barb 33 is formed by fusing the two layers of polyester material to each other. Band 17 is defined by fused seam 34 which merges into fused seam 30 and by fused seam 35 which merges into the junction of fused seams 20 and 21. An aperture 37 is formed in the outer end of band 17 and it is defined by a fused seam 39 which merges into fused seams 34 and 35.

Figure 3:
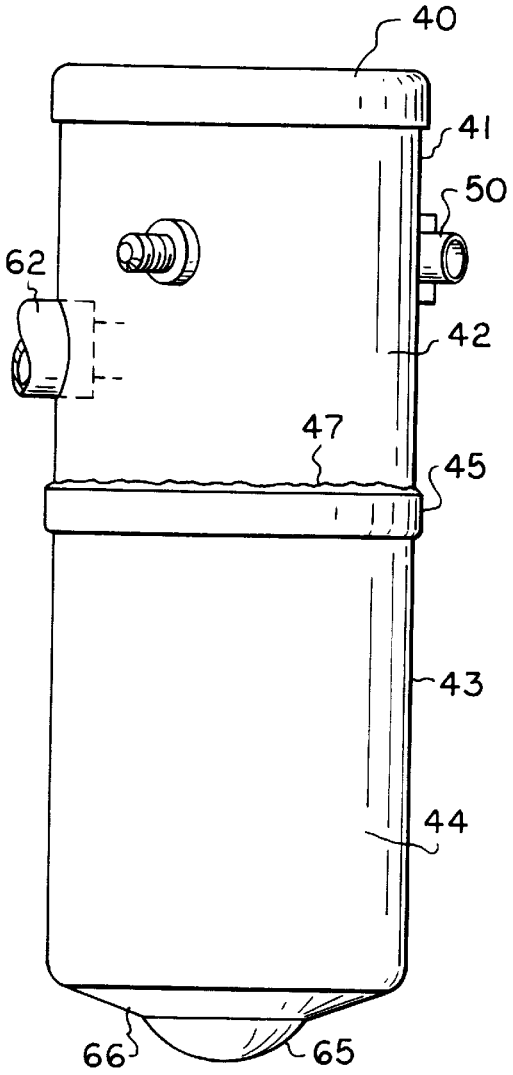
FIG. 3 is a side elevational view of an accumulator type of receiver in which the adsorbent unit is mounted.

The adsorbent unit 10 is intended to be mounted in a prior art accumulator-type of receiver 40 (FIGS. 3 and 4) which includes an upper cylindrical housing portion 41 having a side wall 42 and a lower cylindrical housing portion 43 having a side wall 44 and having a flange 45 which receives the lower edge portion of upper portion 41 with an interference fit, and a joint is thereafter hermetically welded at 47. Insofar as pertinent here, the accumulator 40 includes a U-bend pipe 49 having a refrigerant inlet end 50 which receives a mix of gaseous and liquid refrigerant and conducts it through pipe 51 having an open end 52 proximate concave surface 53 such that the refrigerant impinges thereon and enters the accumulator. The upper end 54 of U-shape pipe 49 is open and it receives gaseous refrigerant which passes through pipe 55, return bend 57, pipe 60, and pipe 61 to outlet 62 which leads to the compressor, as is well known in the art. As noted above, the gaseous refrigerant passes through U-shaped tube 49 because it rises to the top while the liquid refrigerant from the evaporator drops to the bottom of the accumulator. A lubricant inlet (not shown) is located at the underside of the return bend 57. A filter housing 63 having a filter 64 thereon is in communication with the lubricant inlet in the return bend 57 such that lubricant which accumulates in depression 65 of bottom wall 66 is induced into the return bend and conveyed with the gaseous refrigerant to the compressor, as is well known in the art. As can be seen from FIG. 4, the U-bend 49 includes two spaced pipes 55 and 60 which are connected by U-bend 57. In the present instance, pipe 60 is substantially vertical and pipe 55 is inclined. The U-bend 49 is sometimes referred to as a J-bend.

Figure 5:
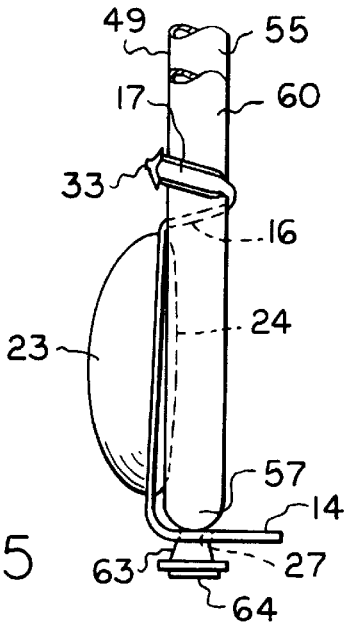
FIG. 5 is a fragmentary side elevational view taken substantially in the direction of arrows 5—5 of FIG. 4.
Figure 4:
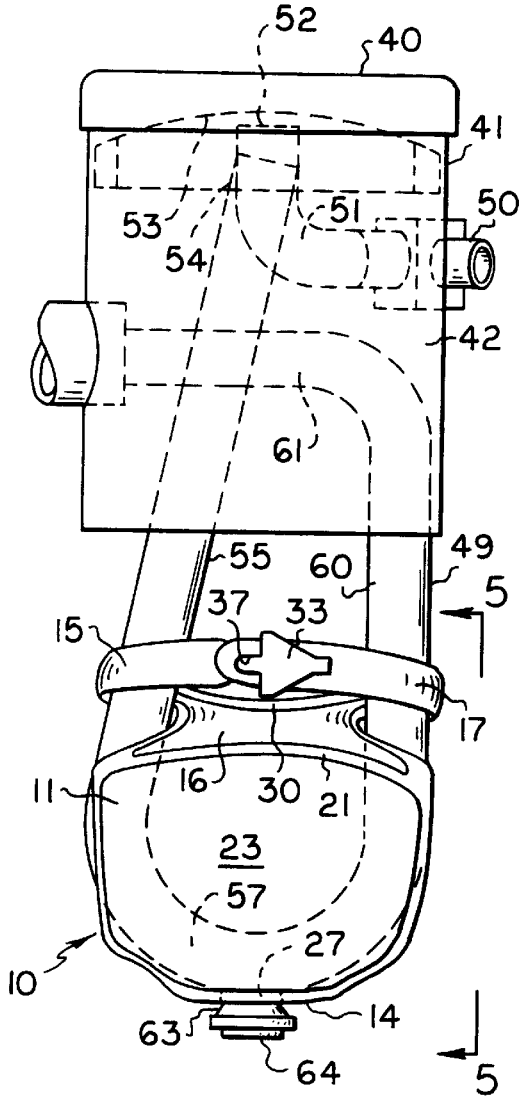
FIG. 4 is a side elevational view of the accumulator of FIG. 3 with the bottom portion removed and the adsorbent unit of the present invention mounted relative to the U-bend pipe therein.

In FIGS. 4 and 5 the adsorbent unit 10 is shown mounted on U-bend 49. In this respect filter housing 63 is received within aperture 27 of tab 14. The side 24 of container 12 is placed adjacent U-bend pipe 49. The end portion 16 of casing 11 is threaded through the space between pipes 55 and 60 and bands 15 and 17 are thereafter looped about pipes 55 and 60, respectively, and barb 33 of band 15 is threaded through aperture 37 of band 17 to provide a looped relationship with pipes 55 and 60, the looped relationship consisting of the end portion 60 of casing 11 and bands 15 and 17.

Figure 6:
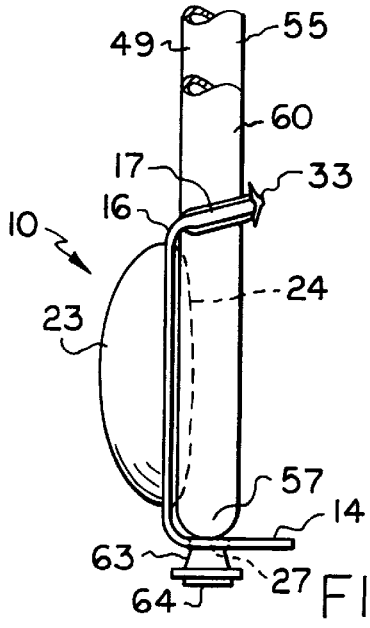
FIG. 6 is a fragmentary side elevational view similar to FIG. 5 but showing the adsorbent unit mounted in a different manner.

In FIG. 6 an alternate mounting arrangement is shown wherein the end portion 16 of casing 11 is not threaded through the space between pipes 55 and 60, but instead the bands 15 and 17 and end portion 16 are merely looped about pipes 55 and 60, as depicted in FIG. 6.

While a barb 33 and an aperture 37 have been shown for securing the outer ends of bands 15 and 17 to each other, it will be appreciated that any other suitable types of fastening structure may be used.

While preferred embodiments of the present invention have been disclosed, it will be appreciated that the present invention is not limited thereto but may be otherwise embodied within the scope of the following claims.

What is claimed is:

1. In a refrigerant accumulator having a housing with a bottom wall and a side wall and a U-shaped pipe with a return bend adjacent said bottom wall and with first and second pipe portions extending from said return bend along said side wall, and a filter body extending outwardly from said return bend, the improvement of an adsorbent unit comprising a porous adsorbent container, adsorbent in said container, first and second end portions on said container, first and second bands, inner ends on said first and second bands secured to said first end portion, outer ends on said first and second bands, means securing said outer ends of said first and second bands to each other in looping engagement with said first and second pipe portions, a tab extending outwardly from said second end portion of said container, and an aperture on said tab mounting said second tab on said filter body.

2. An adsorbent unit for mounting relative to a U-bend pipe of a refrigerant accumulator having spaced pipes and a return bend having a filter body on its underside comprising a porous container, adsorbent in said container, first and second end portions on said container, first mounting means on said first end portion for placement about said spaced pipes with said container located between said first mounting means and said return bend, and second mounting means at said second end portion of said container for mounting on said filter body on said U-bend pipe.

3. An adsorbent unit as set forth in claim 2 wherein said porous container and said first and second mounting means are fabricated from fusible fabric.

4. An adsorbent unit for mounting relative to a U-bend pipe of a refrigerant accumulator having spaced pipes and a return bend comprising a porous container, adsorbent in said container, first and second end portions on said container, first and second bands on said first end portion for placement about said spaced pipes with said container located between said first and second bands and said return bend, and mounting means at said second end of said container for mounting relative to said return bend.

5. An adsorbent unit as set forth in claim 4 wherein said porous container and said first and second mounting means are fabricated from fusible fabric.

6. An adsorbent unit comprising an adsorbent container, adsorbent in said container, first and second end portions on said container, a tab on said first end portion, an aperture in said tab, and first and second bands having inner ends secured to said second end portion and outer ends remote from said second end portion.

7. An adsorbent unit as set forth in claim 6 including a second aperture in said first band remote from said inner end thereof, and a barb on said second band remote from said inner end thereof.

8. In a refrigerant accumulator having a housing with a bottom wall and a side wall and a U-shaped pipe with a return bend adjacent said bottom wall and with first and second pipe portions extending from said return bend along said side wall, said refrigerant receiver also including a filter body extending outwardly from said return bend, the improvement of an adsorbent unit comprising a porous adsorbent container, adsorbent in said container, first and second end portions on said container, a tab extending outwardly from said first end portion of said container, a first aperture in said first tab mounting said first tab on said filter body, first and second bands extending outwardly from said second end portion of said container, a second aperture in said first tab remote from said second end portion, a barb on said second band remote from said second end portion, said barb being received in said second aperture, and said first and second bands being looped about at least one of said first and second pipe portions.

9. In a refrigerant accumulator as set forth in claim 8 wherein said container and said tab and said first and second bands are fabricated out of fusible fabric, and wherein said tab and said first and second bands and said second aperture and said barb are outlined by fused seams.

10. In a refrigerant accumulator as set forth in claim 9 wherein said first and second bands are substantially planar.

11. An adsorbent unit comprising a porous container, adsorbent in said container, first and second end portions on said container, a tab on said first end portion, an aperture in said tab, first and second bands extending outwardly from said second end portion, said first and second bands in combination with said second end portion forming an elongated slot when first and second portions of said first and second bands, respectively, remote from said second end portion are secured to each other.

12. An adsorbent unit as set forth in claim 11 including an aperture in said first portion of said first band, and a barb in said second portion of said second band.

13. In a refrigerant accumulator as set forth in claim 1 wherein said first and second bands include first band portions adjacent said first end portion of said container and second band portions between said first band portions and said outer ends of said first and second bands, and wherein said looping engagement comprises said first band portions being within said first and second pipe portions and said second band portions being around the outside of said first and second pipe portions.

14. In a refrigerant accumulator as set forth in claim 13 wherein said means securing said outer ends of said first and second bands to each other are located on the same side of said first and second spaced pipe portions of said container.

* * * * *